US007926144B1

(12) United States Patent
Whittaker

(10) Patent No.: US 7,926,144 B1
(45) Date of Patent: Apr. 19, 2011

(54) ROLLERS AND DISKS FOR CARPET CLEANING

(75) Inventor: Richard E. Whittaker, New Castle, PA (US)

(73) Assignee: R.E. Whittaker Company, Inc., New Castle, PA (US)

( * ) Notice: Subject to any disclaimer, the term of this patent is extended or adjusted under 35 U.S.C. 154(b) by 0 days.

(21) Appl. No.: 12/893,296

(22) Filed: Sep. 29, 2010

Related U.S. Application Data

(63) Continuation-in-part of application No. 12/613,915, filed on Nov. 6, 2009, now Pat. No. 7,814,613, which is a continuation of application No. 11/249,671, filed on Oct. 13, 2005, which is a continuation-in-part of application No. 10/964,015, filed on Oct. 13, 2004, now abandoned, which is a continuation-in-part of application No. 10/832,519, filed on Apr. 27, 2004, now abandoned.

(60) Provisional application No. 60/513,689, filed on Oct. 23, 2003.

(51) Int. Cl.
*A47L 9/04* (2006.01)

(52) U.S. Cl. ..... 15/366; 15/383; 15/179; 15/141.2; 492/30

(58) Field of Classification Search ..... 15/179, 15/180, 183, 363, 346, 366, 383, 385, 141.2; 492/30–38
See application file for complete search history.

(56) References Cited

U.S. PATENT DOCUMENTS

| | | | | |
|---|---|---|---|---|
| 2,393,529 | A * | 1/1946 | Harrigan | 118/262 |
| 2,638,706 | A * | 5/1953 | Seale | 446/256 |
| 2003/0148036 | A1 * | 8/2003 | Fernandez | 427/428 |

* cited by examiner

*Primary Examiner* — Shay L Karls
(74) *Attorney, Agent, or Firm* — Cohen & Grigsby, P.C.

(57) ABSTRACT

The claimed carpet cleaning apparatus incorporates recesses in a rigid surface of a roller, a hand-operated cleaning device, or a rigid disk. The rigid surface compresses the fibers of the soft surface as the device and the recesses decompress the fibers. The repeated compression and decompression, preferably in combination with a cleaning compound, provide the mechanical action necessary for removal of foreign material.

9 Claims, 21 Drawing Sheets

ROLLERS AND DISKS FOR CARPET CLEANING

CLAIM OF PRIORITY

This application is a continuation-in-part of U.S. Non-Provisional application Ser. No. 12/613,915, filed on Nov. 6, 2009, which is a continuation of U.S. Non-Provisional application Ser. No. 11/249,671 filed on Oct. 13, 2005, which is a continuation-in-part of U.S. Non-Provisional application Ser. No. 10/964,015 filed on Oct. 13, 2004, which is a continuation-in-part of U.S. Non-Provisional application Ser. No. 10/832,519 filed on Apr. 27, 2004, which claims priority to U.S. Provisional Application No. 60/513,689 filed on Oct. 23, 2003.

BACKGROUND OF THE PRIOR ART

Typically, soft surface cleaning involves the use of a soft surface cleaning device. A soft surface cleaning device typically comprises cylindrical agitators containing a brush or cloth. The agitator is moved across the soft surface or turned upon the soft surface to provide mechanical action to dislodge foreign matter and debris.

Traditional agitators can cause deterioration to the soft surface material. The damage caused can be attributed to the conventional agitator's orientation, pressure, and abrasiveness. Often times, conventional agitators will accomplish the opposite of that which they are designed to accomplish. That is, a conventional agitator having groupings of brush bristles have been known to thrust the debris into the irregularities of the soft surface, rather than simply dislodging the debris for eventual removal. Furthermore, aggressive mechanical action caused by brush bristles often results in pile burst and fuzzing which have deleterious effect on the physical structure of the carpet pile. Also, groups of bristles on a conventional brush could be pulled through the fiber of the soft surface, e.g., carpet, causing potential distortion and damage to the soft surface.

Similarly, the brushes or bristles of conventional hand-operated cleaning devices, such as scrub brushes, can damage soft surfaces when the soft surface is scrubbed. Furthermore, in use, conventional scrub brushes tend to grind foreign matter and debris deep into the fibers of the soft surface rather than removing such matter and debris from within or between the fibers.

Thus, there exists a need for a soft surface cleaning apparatus that reduces damage to soft surfaces, such as carpet, while being equally if not more effective than conventional agitators. Further, there exists a need for a soft surface cleaning apparatus that will not thrust debris into the surface being cleaned, but rather will aid in the removal of such debris. Similarly, there is a need for a hand-operated cleaning device that is able to effectively clean a soft surface without damaging or destroying the soft surface.

SUMMARY

Embodiments of cleaning devices having a rigid surface that includes recesses therein are disclosed. The rigid surface and recesses therein provide for a less aggressive mechanical action that minimizes the risk of pile burst and fuzzing caused by conventional bristle brushes.

In an embodiment, the soft surface cleaning apparatus of the claimed invention comprises a rotatable cylindrical roller having a rigid surface that incorporates recesses therein for contact with a soft surface to be cleaned, and a rotatable support means. As the roller rotates and/or is moved across the surface, the rigid surface contacts and presses downward on the soft surface to be cleaned and compresses it. The recesses in the surface of the roller provide the opportunity for areas of the soft surface to temporarily decompress to their original position and then recompress again when the rigid surface of the roller contacts and presses down on the soft surface again. This repeated compression, decompression, and recompression, preferably in combination with a cleaning compound, provides the mechanical action necessary for removal of foreign material from deep within the soft surface. The roller preferably comprises recesses having a cone shape, but may incorporate recesses of various lengths, depths, shapes, and configurations.

In another aspect of the invention, the soft surface cleaning apparatus comprises a rigid rotatable disk with a plurality of spaced-apart recesses therein for contact with a soft surface to be cleaned, and a rotatable support means. As the disk rotates and is moved horizontally across the soft surface, there is a repeated compression, decompression, and recompression of the soft surface, preferably in combination with a cleaning compound, that removes foreign matter from deep within the soft surface, as described above.

In another embodiment, a hand-operated cleaning device is disclosed. The hand-operated cleaning device is for use on soft surfaces, including carpeting, upholstery, fabrics, clothing, and the like. The hand-operated cleaning device has a body that includes a first side having a rigid surface without projections and a plurality of spaced apart recesses therein. In use, the first side engages the soft surface to be cleaned. As the hand-operated cleaning device is moved across the surface, the rigid surface contacts and presses downward on the soft surface to be cleaned and compresses it. The recesses in the rigid surface provide the opportunity for areas of the soft surface to temporarily decompress to their original position and then recompress again when the rigid surface contacts and presses down on the soft surface again. This repeated compression, decompression, and recompression, optionally in combination with a cleaning compound, provides the mechanical action necessary for removal of foreign material from within the soft surface. The roller preferably comprises recesses having a cone shape, but may incorporate recesses of various lengths, depths, shapes, and configurations.

In another embodiment, a cleaning kit for cleaning a soft surface is disclosed. The kit has a hand-operated cleaning device. The hand-operated cleaning device has a body that includes a first side having a rigid surface without projections for engaging the soft surface and a plurality of spaced apart recesses therein. The kit also has a cleaning compound for application to the soft surface. In use, the cleaning compound is applied to the soft surface and as the hand-operated cleaning device is moved across the surface, the rigid surface contacts and presses downward on the soft surface to be cleaned and compresses it. The recesses in the rigid surface provide the opportunity for areas of the soft surface to temporarily decompress to their original position and then recompress again when the rigid surface contacts and presses down on the soft surface again. This repeated compression, decompression, and recompression massages the cleaning compound into the soft surface and provides the mechanical action necessary for removal of foreign material from within the soft surface. The roller preferably comprises recesses having a cone shape, but may incorporate recesses of various lengths, depths, shapes, and configurations.

The recesses embedded in the rigid surface of the roller, the rigid disk, or the hand-operated cleaning device insure consistent pressure with no build up of heat or sideward compression or rebound of the soft surface where such action could cause distortion or damage.

Therefore, it is an object of the invention to reduce or eliminate damage to soft surfaces during cleaning, while retaining or surpassing the effectiveness of conventional style cleaning.

It is further object of the invention to remove debris from within the soft surface being cleaned, preferably in combination with a cleaning compound, while thrusting little or no debris into the soft surface.

It is still a further object of the invention to prolong the useful economic life of soft surfaces by effectively cleaning them without damaging or distorting them.

It is still a further object of the invention to cause less strain on the motor of the soft surface cleaning machine as compared to conventional bristle orientations, which create large amounts of friction.

It is still another object of the invention to provide a soft surface cleaning apparatus that requires minimum maintenance.

It is another object of the invention to provide an apparatus for cleaning soft surfaces that reduces cleaning costs and increases productivity.

DETAILED DESCRIPTION

Figure 2:
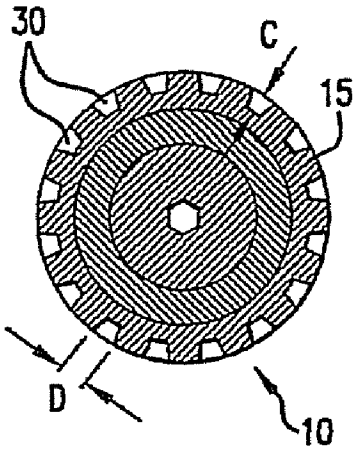
FIG. 2 is a sectional view of the invention from line 2-2 in FIG. 1.
Figure 1:
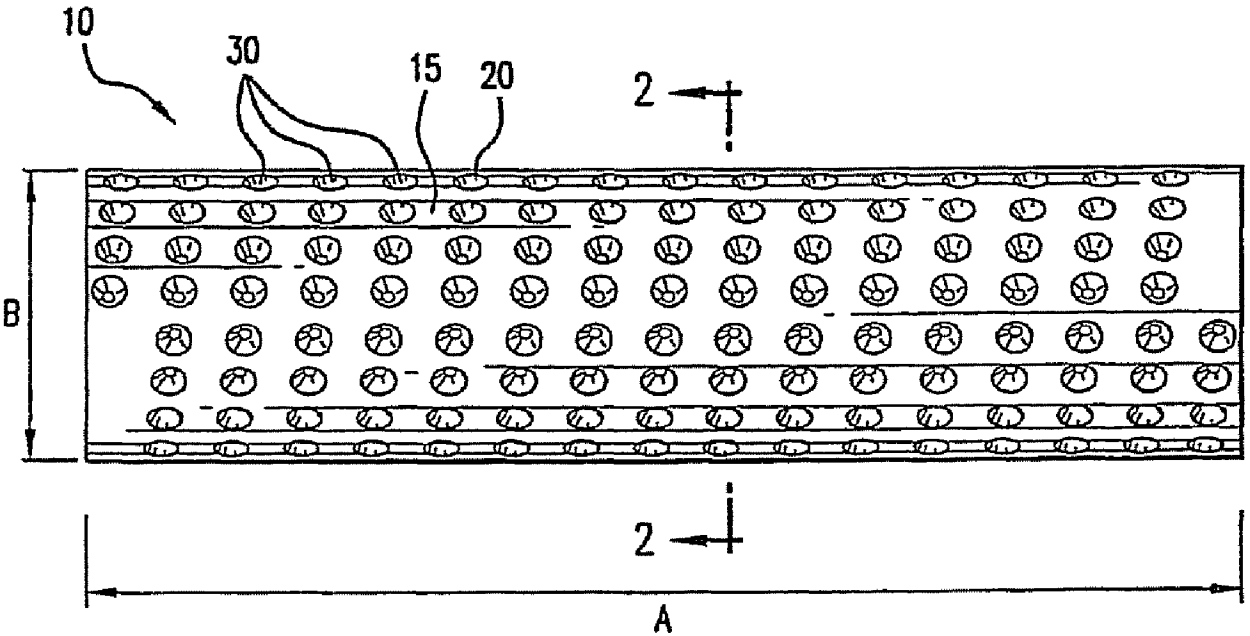
FIG. 1 is a side elevational view of a cylindrical roller having cone shaped recesses according to the present invention.
Figure 3:
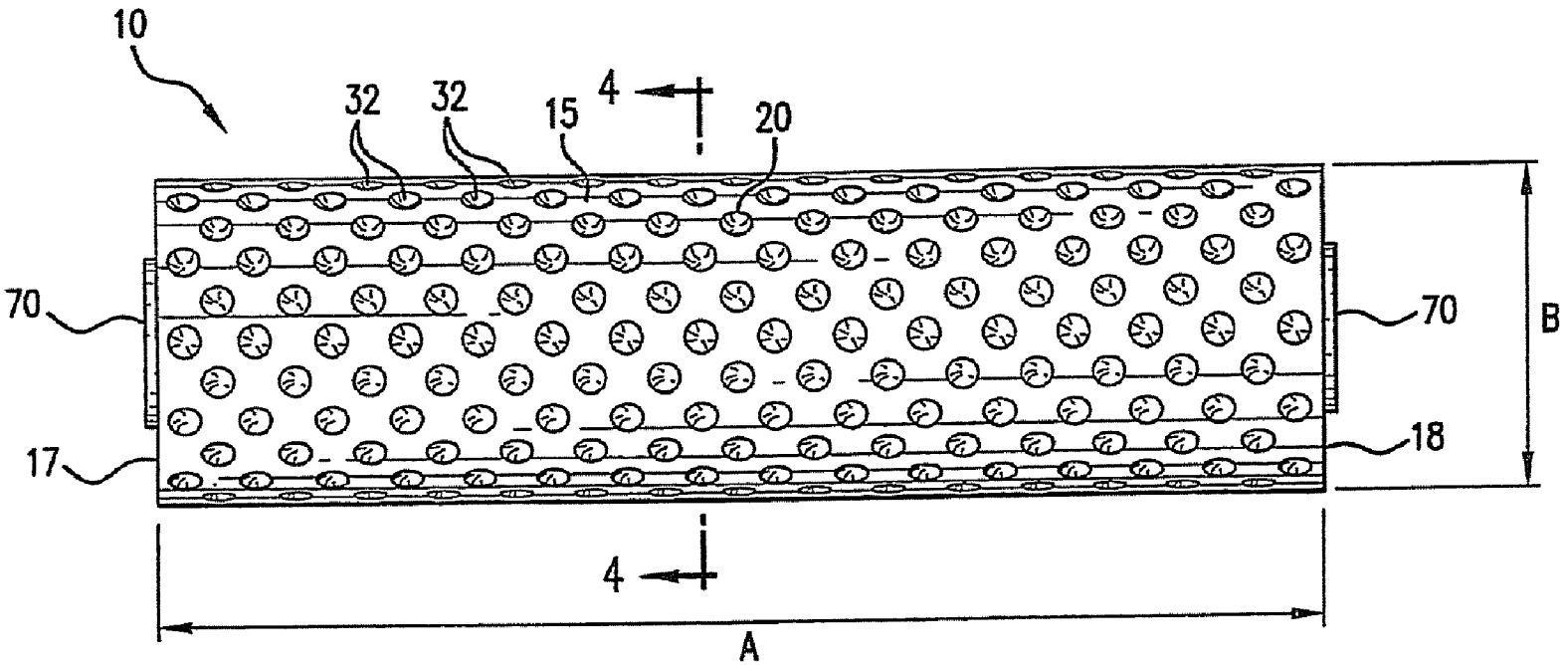
FIG. 3 is a side elevational view of a cylindrical roller having dimple shaped recesses according to the present invention.
Figure 4:
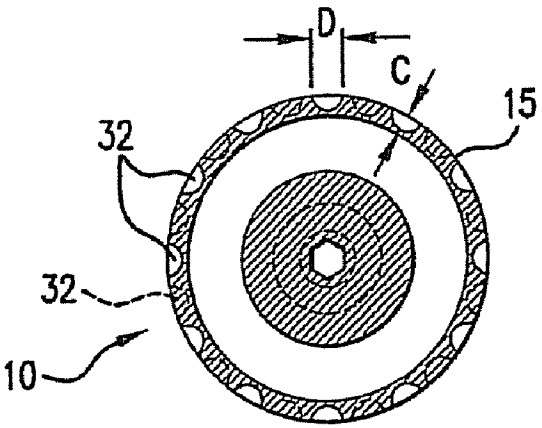
FIG. 4 is a sectional view from line 4-4 in FIG. 3.
Figure 6:
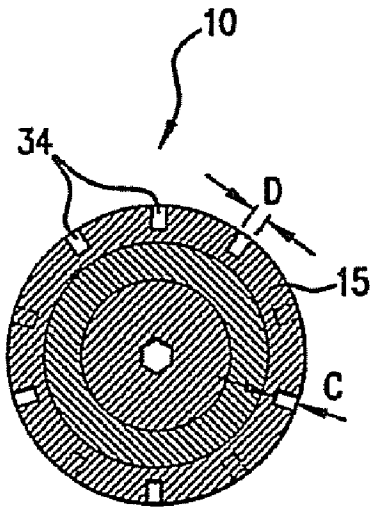
FIG. 6 is a sectional view from line 6-6 in FIG. 5.
Figure 5:
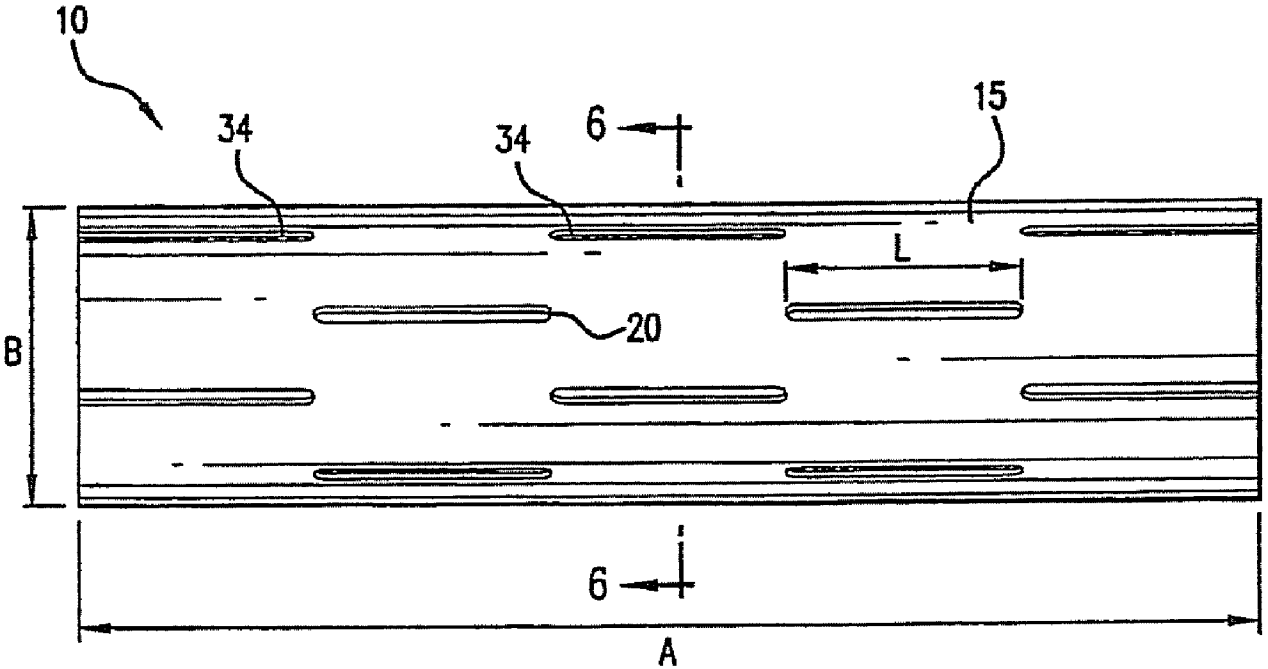
FIG. 5 is a side elevational view of a cylindrical roller having oblong recesses according to the present invention.
Figure 8:
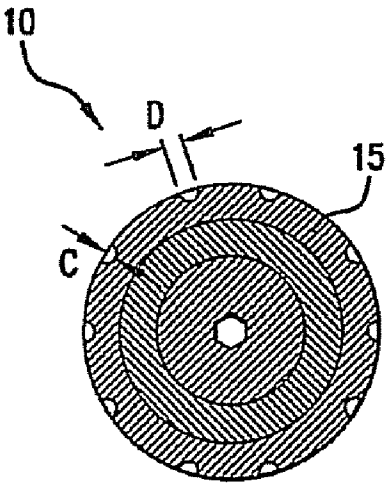
FIG. 8 is a sectional view from line 8-8 in FIG. 7.
Figure 7:
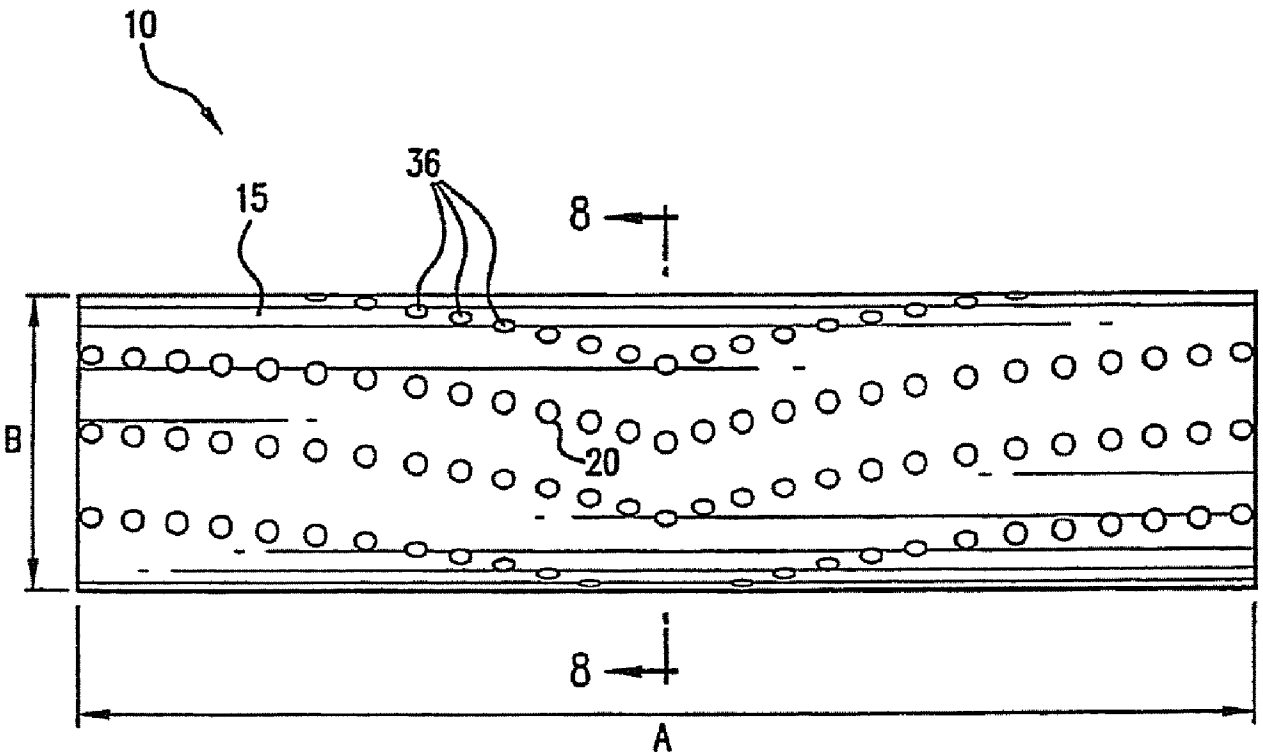
FIG. 7 is a side elevational view of a cylindrical roller having dimple shaped recesses arranged in a v-shaped configuration according to the present invention.
Figure 10:
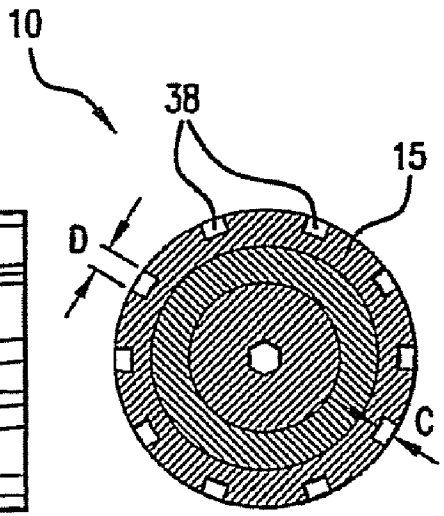
FIG. 10 is a sectional view from line 10-10 in FIG. 9.
Figure 9:
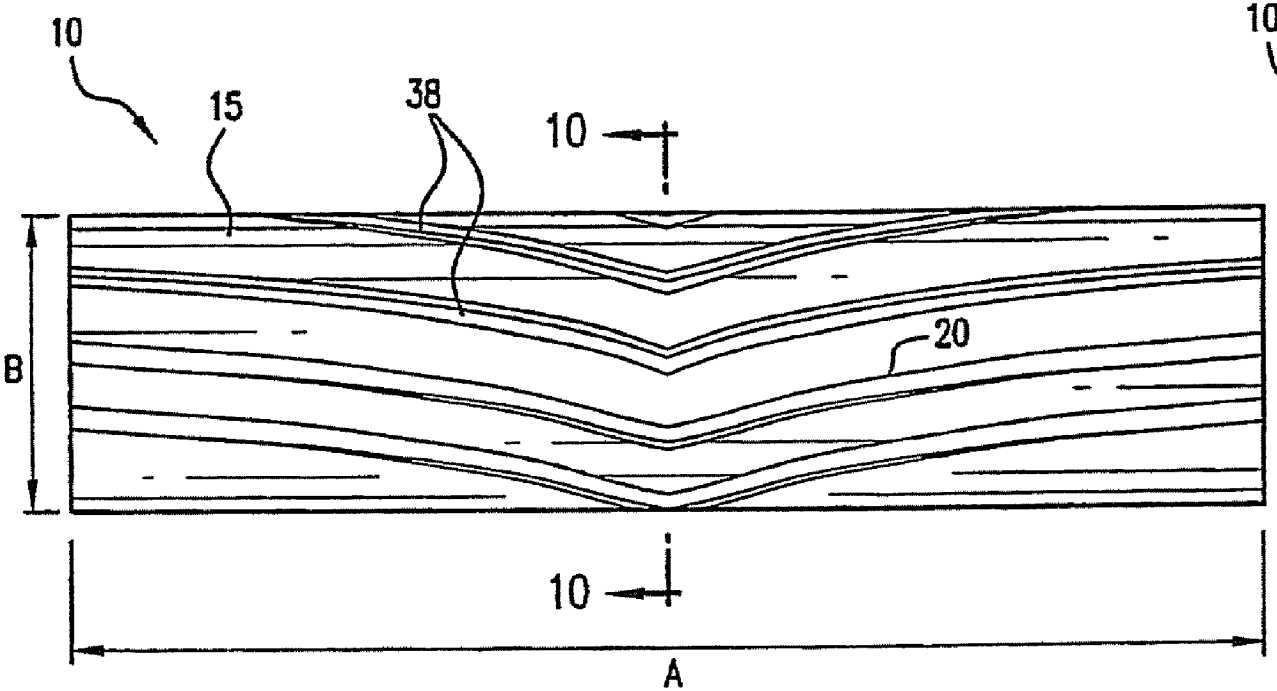
FIG. 9 is a side elevational view of a cylindrical roller having grooved recesses arranged in a V-shaped configuration according to the present invention.
Figure 12:
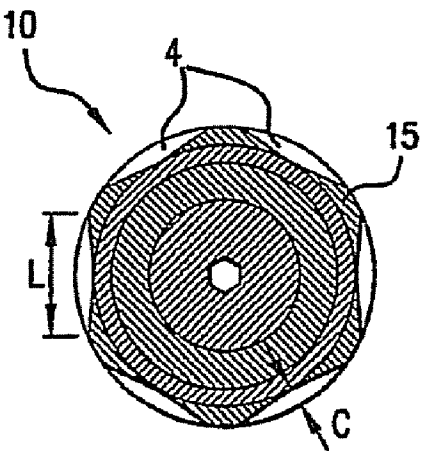
FIG. 12 is a sectional view from line 12-12 in FIG. 11.
Figure 11:
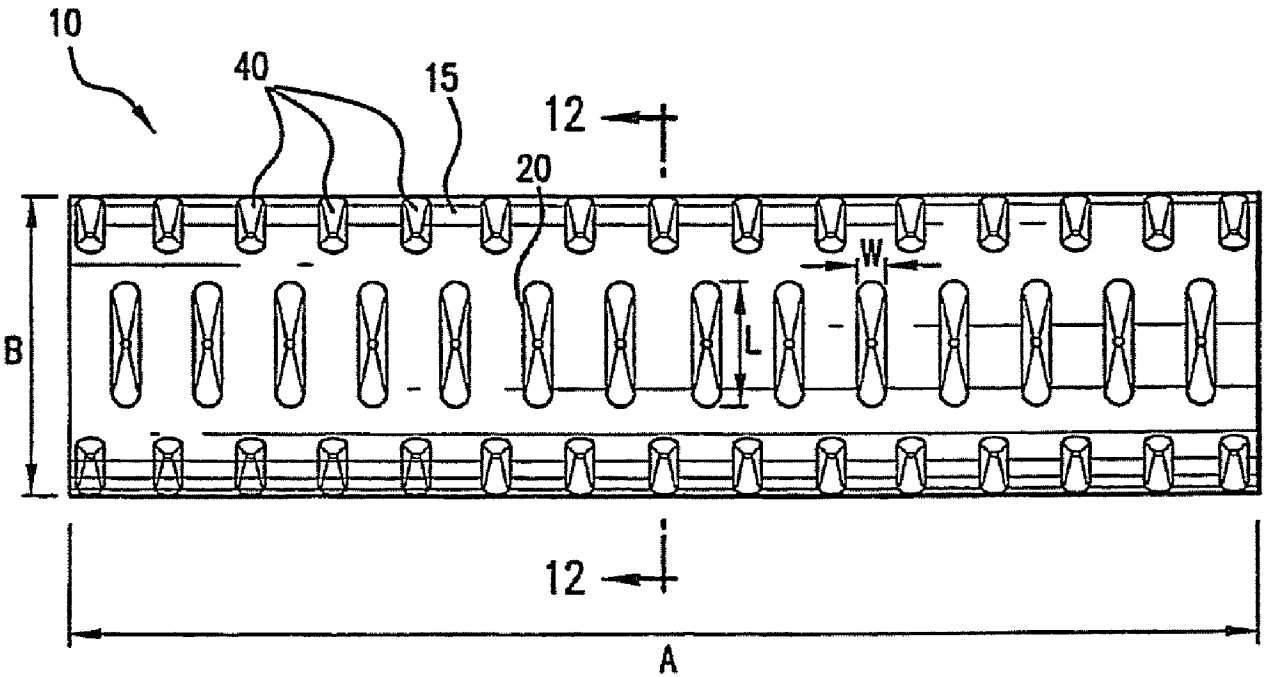
FIG. 11 is a side elevational view of a cylindrical roller having oblong shaped recesses according to the present invention.
Figure 14:
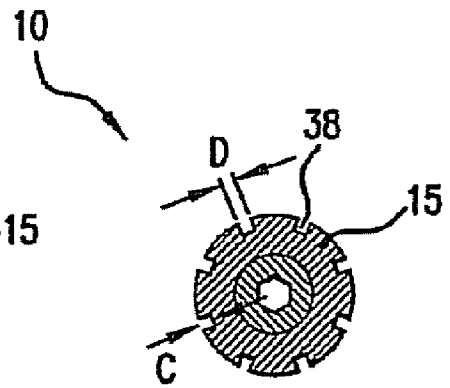
FIG. 14 is a sectional view from line 14-14 in FIG. 13.
Figure 13:
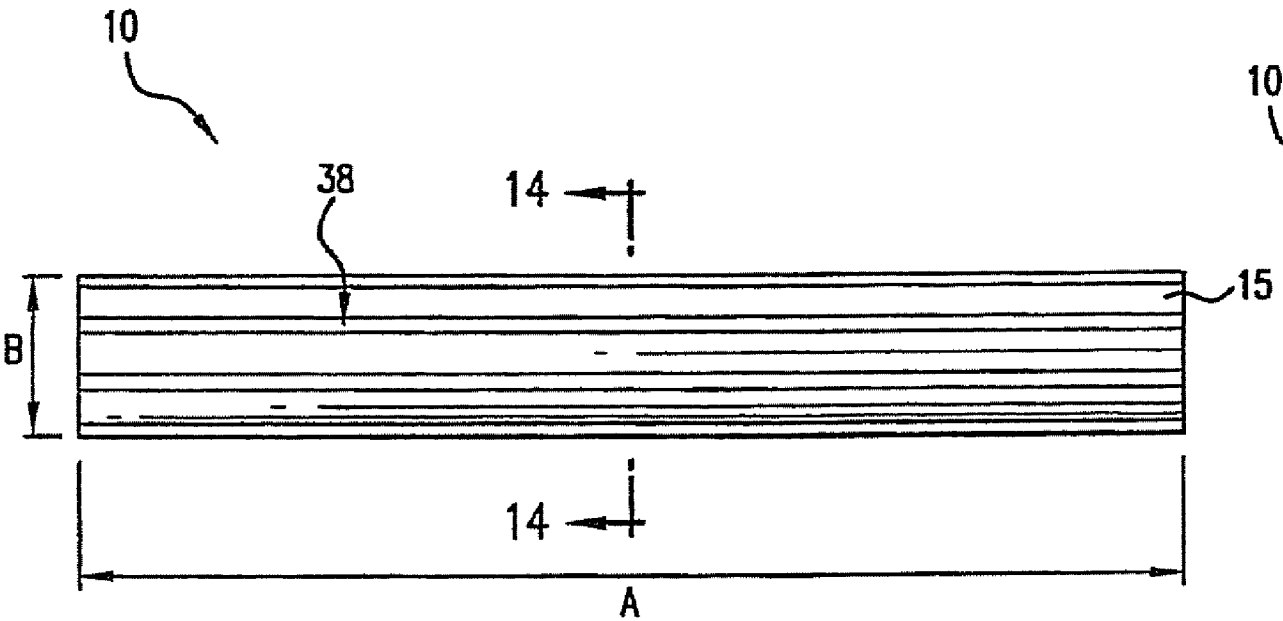
FIG. 13 is a side elevational view of a cylindrical roller having grooved recesses extending substantially the length of the roller according to the present invention.
Figure 16:
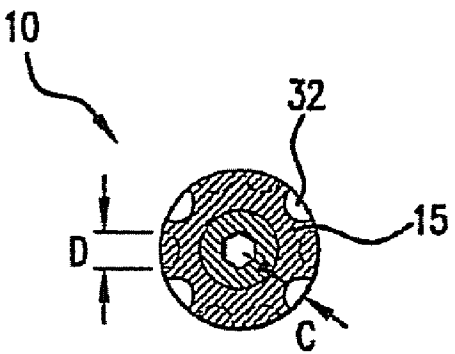
FIG. 16 is a sectional view from line 16-16 in FIG. 15.
Figure 15:
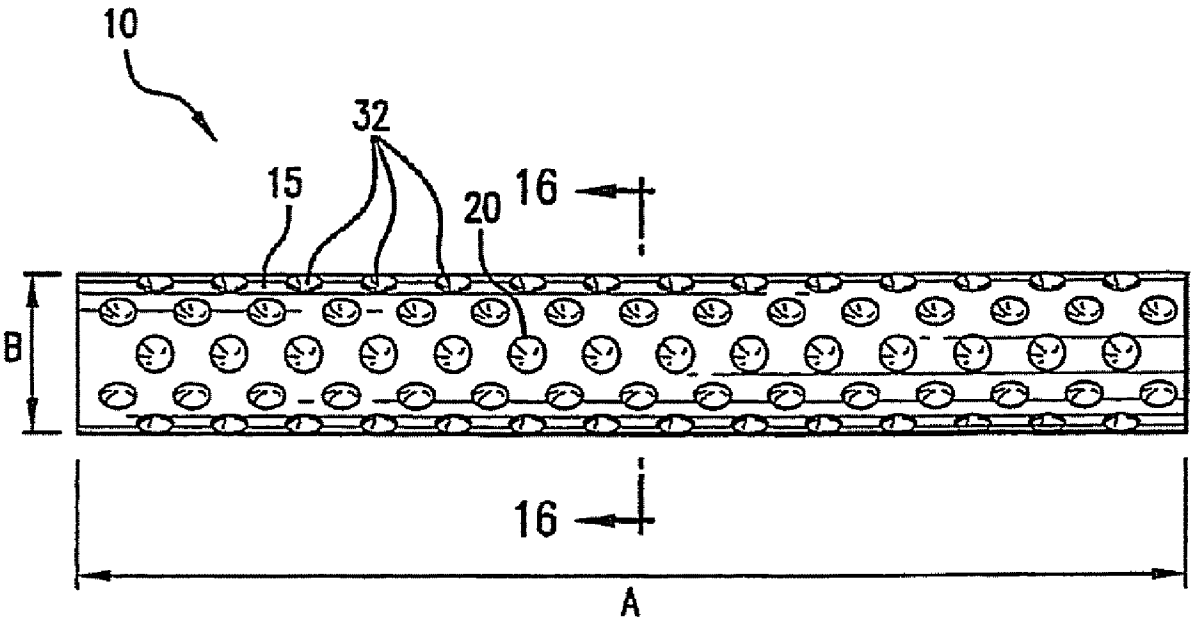
FIG. 15 is a side elevational view of a cylindrical roller having dimple shaped recesses according to the present invention.
Figure 18:
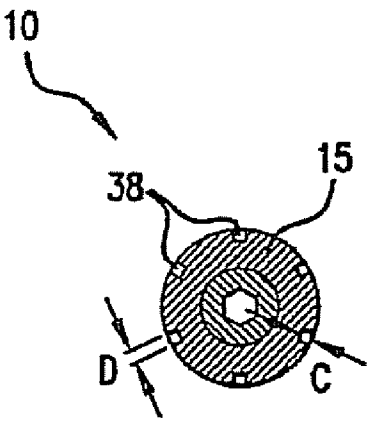
FIG. 18 is a sectional view from line 18-18 in FIG. 17.
Figure 17:
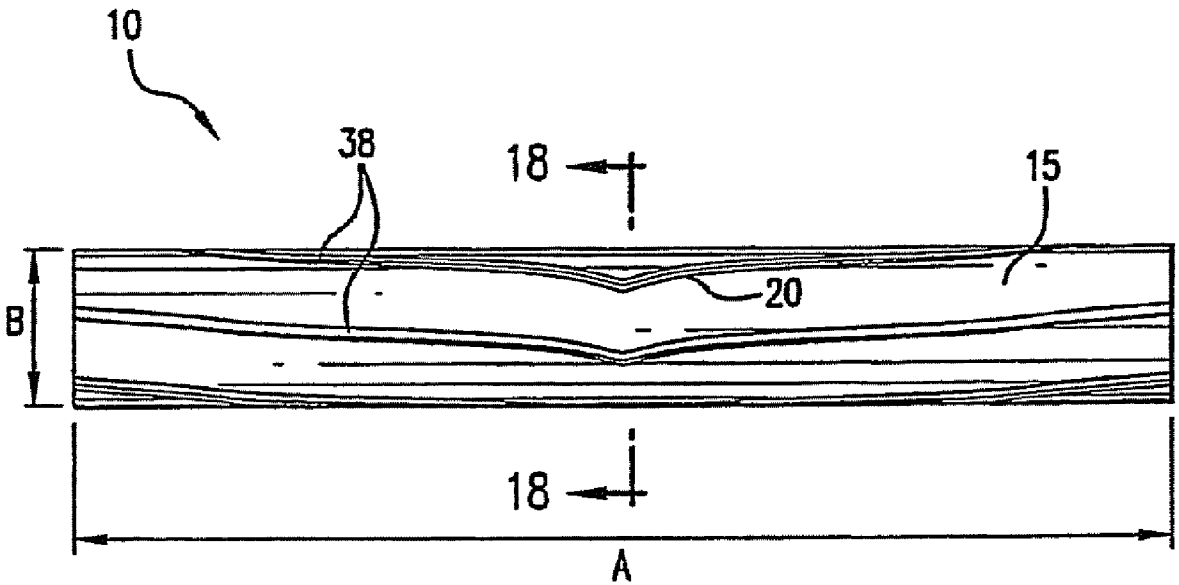
FIG. 17 is a side elevational view of a cylindrical roller having grooved recesses arranged in a v-shaped according to the present invention.

FIGS. 1-18 show examples of an embodiment of the claimed soft surface cleaning apparatus. In the examples shown, the claimed apparatus comprises a rotatable cylindrical roller 10 having a rigid surface 15 with a plurality of spaced-apart recesses 30, 32, 34, 36, 38, 40, in embodiment exemplified, therein for contact with a soft surface to be cleaned, such as, for examples, carpets or rugs. A rotatable support means 60 for rotatably supporting the roller 10 and for attaching roller 10 to cleaning device 200 is also shown. Alternatively, the cylindrical roller can be a solid cylinder with support means to permit rotation. The rigid surface is made of, for examples, polyethylene, polypropylene, thermoelastic polymer (TEP), polystyrene or like material, or a metal, such as stainless steel or aluminum. Preferably, the rigid surface 15 is non-absorbent.

Figure 22:
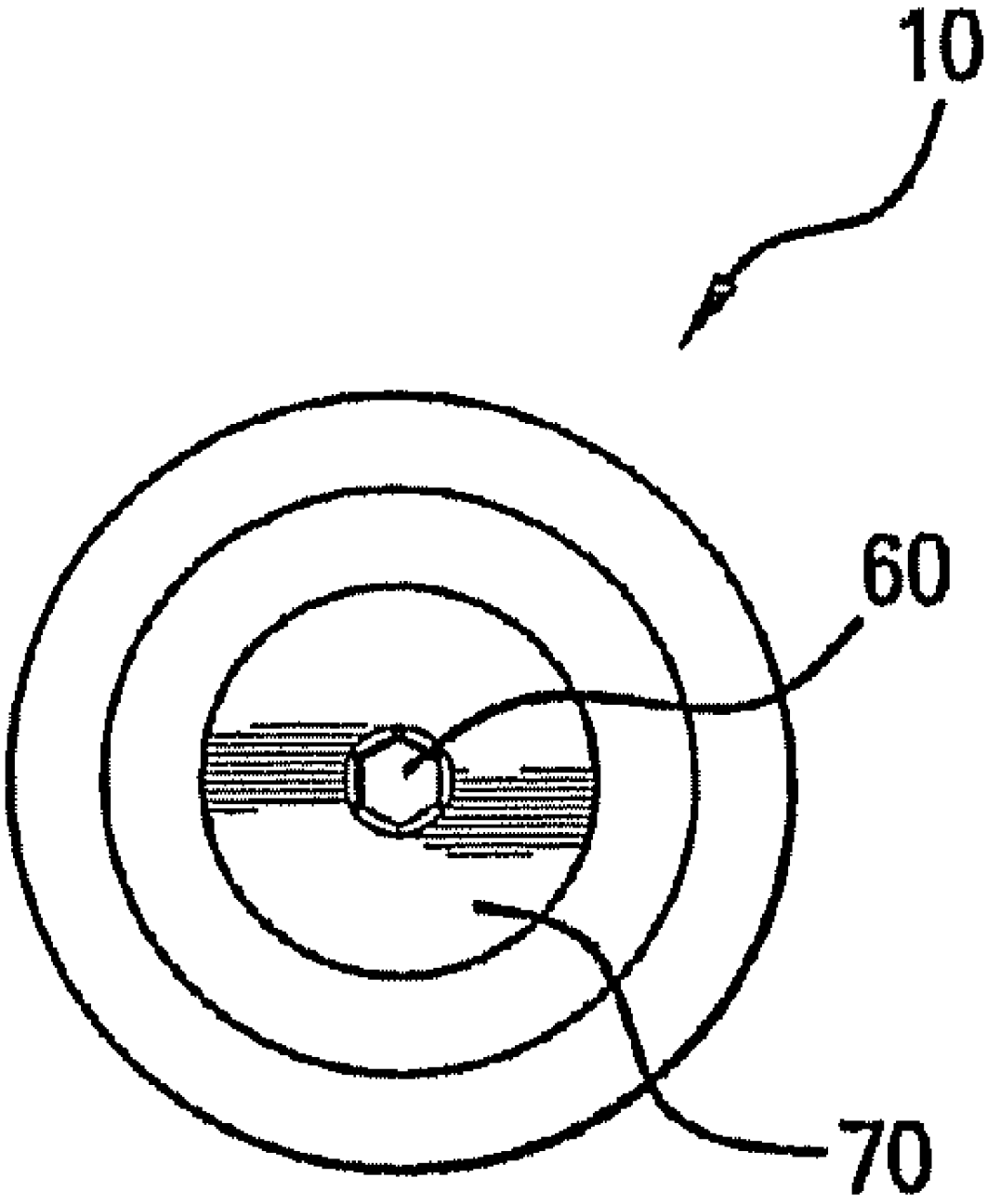
FIG. 22 is a front elevational view of an example of an end of a cylindrical roller having a rotatable support means.

In a preferred embodiment, a rotatable support means 60 comprises an axle attachment means that holds the axle in place (not shown). The axle rod extends through the center of cylindrical roller 10. Rotation of the axle causes roller 10 to rotate. In the examples shown in FIGS. 3 and 22, the rotatable support means is a pair of end caps 70, one inserted into each end 17, 18 of the roller 10. Each end cap 70 has axle attachment means 60 inserted therein. In another embodiment, the rotatable support means is a pair of end caps 70, each end cap 70 containing a first mating piece that has a complementary shape to a second mating piece on the soft surface cleaning device (not shown). The rotation of the second mating piece causes the first mating piece and the roller 10 to rotate.

The recesses 30, 32, 34, 36, 38, 40 in the rigid surface 15 of the roller 10 are indentations of various depths. Preferably each recess configuration is the same on a particular roller to facilitate manufacture. The selected recesses 30, 32, 34, 36, 38, 40 do not extend through the rigid surface 15 (i.e., they are not openings through the cylinder). Recesses 30, 32, 34, 36, 38, 40 are formed in rigid surface 15 by any method well known in the art, including routing, molding, or milling for example. As shown in FIGS. 1-18, recesses may comprise a cone 30, groove 38, circle 36, dimple 32, oblong 34, 40, cross (not shown), or any other configuration. Preferably, at least one perimeter edge 20 of each recess 30, 32, 34, 36, 38, 40 is beveled so that the edge 20 provides a transition zone for the fibers or carpet, thereby minimizing damage to the soft surface being cleaned by creating an edge that is not likely to snag fibers of the soft surface. In another preferred embodiment, there is a frusto-conical bevel that surrounds a cone-shaped recess (not shown). In these embodiments, no part of the recesses 30, 32, 34, 36, 38, 40 protrudes above the rigid surface 15 of the roller 10. Preferably, the recesses have a depth "C" at their deepest point that ranges from about 1/16 inch to about 1 inch. More preferably, "C" ranges from about 1/8 inch to about 1/2 inch. Most preferably, "C" is about 1/4 inch. Preferably, the recesses have an outermost diameter "D" that ranges from about 1/8 inch to about 2 inches, and more preferably from about 1/4 inch to about 1 inch. In those examples where the recesses have a larger diameter "D", there are fewer recesses in the rigid surface. In those examples where the recesses comprise oblong channels or grooves, the recesses may have a length "L" ranging from about 1/8 inch to a length that is a subset the length of the cylinder. These oblongs or grooves may have a width "W" that ranges from about 1/8 inch to about 1 inch. As shown in FIGS. 1-18, recesses 30, 32, 34, 36, 38, 40 may be arranged on the rigid surface 15 of the cylindrical roller 10 in any of a variety of configurations. In a preferred example shown in FIG. 1, the recesses 30 substantially cover the rigid surface 15 of the roller 10 and are arranged in a circular configuration around the diameter of the roller 10. In another example shown in FIG. 3, the recesses 32 are arranged in a spiral row that substantially extend the length "A" of roller 10. In other examples, the rows of recesses are substantially V-shaped (see FIGS. 7, 9, 17). Other examples are also shown in FIGS. 1-18. In examples, the arrangement or configuration of the recesses may determine or influence the number and/or size of the recesses.

The cylindrical roller 10 may be either solid or hollow. Those skilled in the art will appreciate that the length "A" and diameter "B" of the cylindrical roller 10 may be determined by the specifications of the soft surface cleaning device 200 to which the roller 10 will be attached. The environment in which roller 10 will be used may also determine length "A" and diameter "B" of the roller. For example, a roller for use in a commercial environment may have a longer length "A" and greater diameter "B" (see FIGS. 1, 3, 5, 7, 9, 11) compared to those for use in a residential environment (see FIGS. 13, 15, 17). In examples shown, length "A" of cylindrical roller 10 preferably ranges from about 10 inches to about 60 inches, and more preferably ranges from about 15 inches to about 40 inches. Most preferably, length "A" of cylindrical roller 10 is about 25 to 30 inches. Diameter "B" of cylindrical roller 10 preferably ranges from about 2 inches to about 12 inches, and more preferably from about 3 inches to about 8 inches. Most preferably, diameter "B" of cylindrical roller 10 is about 4 inches.

Figure 19:
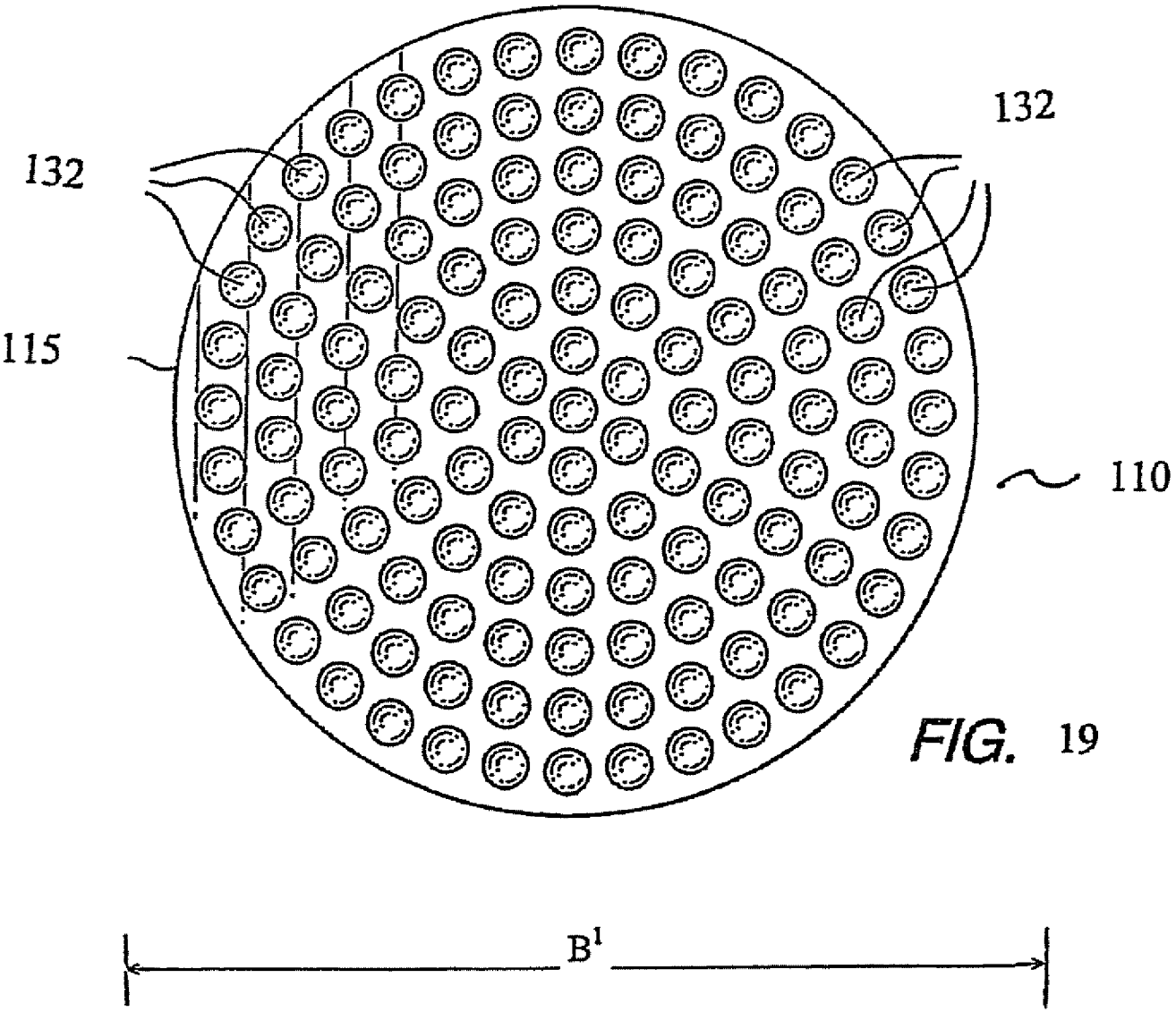
FIG. 19 is a bottom view of a rotatable disk according to the present invention.

In another embodiment shown in FIG. 19, the soft surface cleaning apparatus is a rigid rotatable disk 110. As described above for the cylindrical roller 10, the rigid rotatable disk 110 has a plurality of spaced-apart recesses 130 therein for contact with a soft surface to be cleaned. There is a rotatable support means (not shown) for rotatably supporting the disk and for attaching disk 110 to cleaning device 200.

The range of depths C1 and diameters D' or lengths (not shown), depending on shape, of the recesses 132 in the rigid disk 110 are about the same as those described above. The recesses 132 may be arranged on the rigid disk 110 in any variety of configurations. In the example shown in FIG. 6, the recesses 132 are arranged in a series of circular patterns over a contacting surface 115 of the disk 110. The skilled artisan will appreciate that the thickness (not shown) and diameter B1 of the rotatable disk 110 may be determined by the specifications of the soft surface cleaning device 200 to which the disk 110 will be attached and/or by the environment in which the disk 110 will be used. For example, a rotatable disk 110 for use in a commercial environment may have a larger diameter B1 than those for use in a residential environment. In examples, the diameter B1 of the rotatable disk 110 preferably ranges from about 6 inches to about 20 inches, and more preferably is about 10 inches. In examples, the thickness of the rotatable disk 110 preferably ranges from about 1/4 inch to about 1 inch, and most preferably is about 1/2 thick.

There is a rotatable support means for rotatably supporting the disk and for attaching the disk to the cleaning device 200. Examples are similar to those described above.

Figure 20:
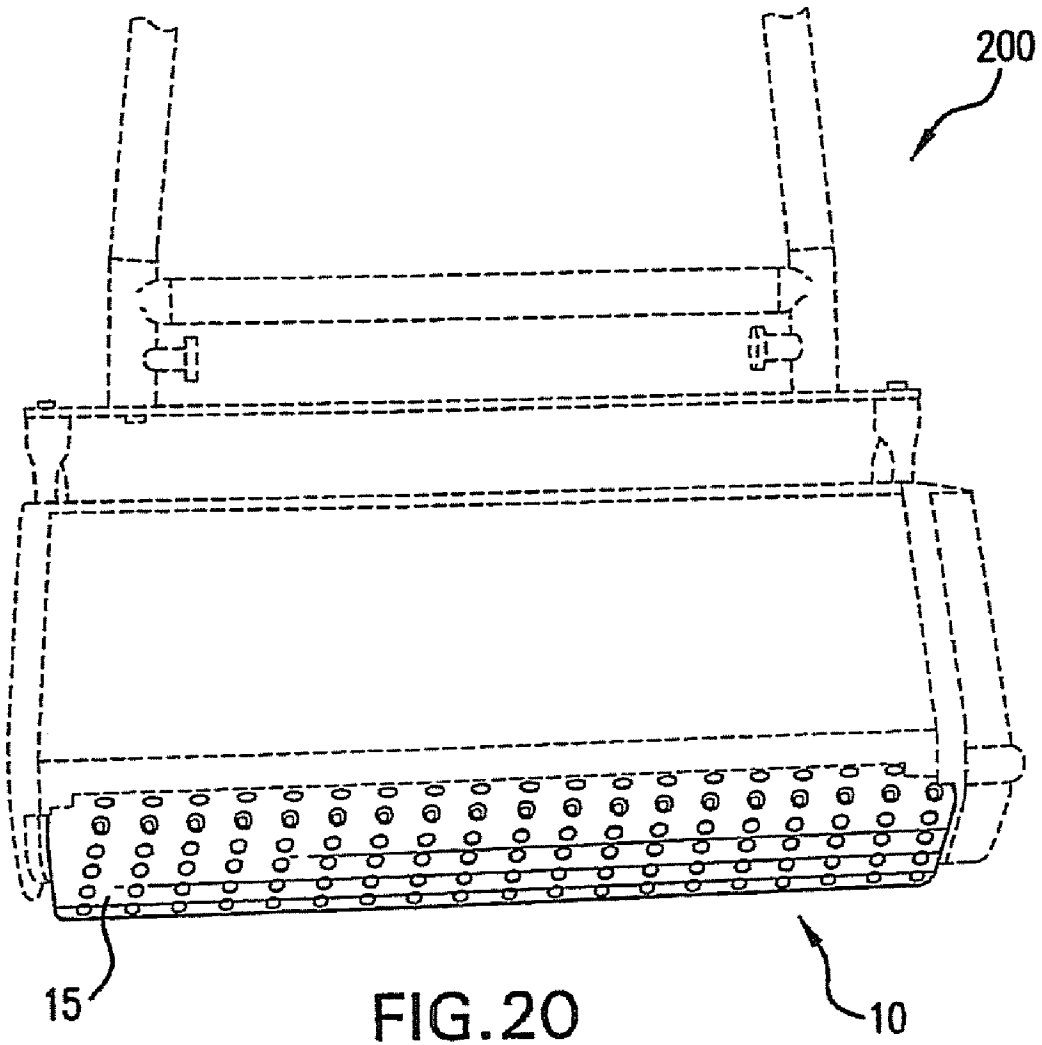
FIG. 20 is a front elevational view of an example of a soft surface cleaning device having a pair of cylindrical rollers mounted thereon.
Figure 21:
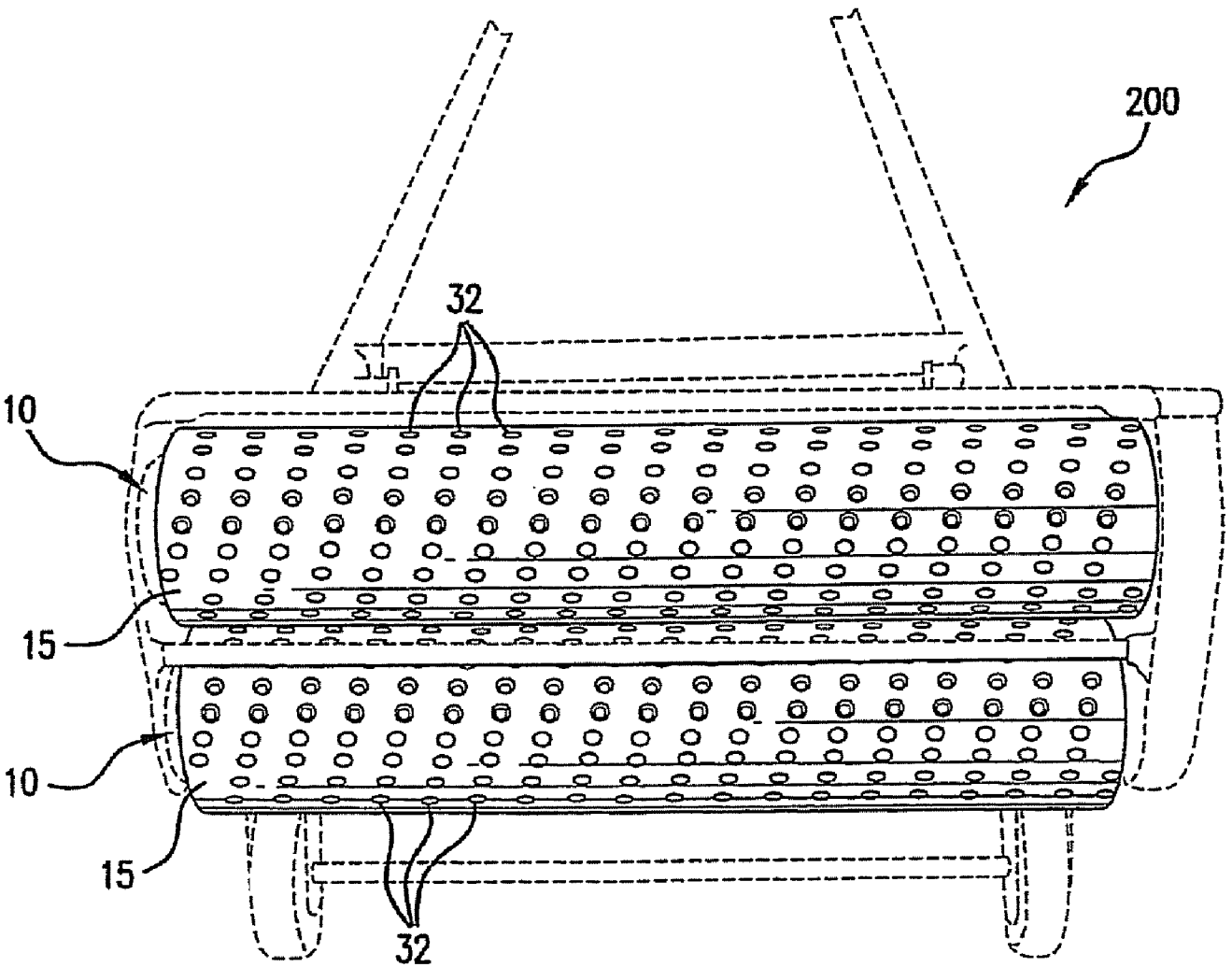
FIG. 21 is a bottom view of an example of a soft surface cleaning device having a pair of cylindrical rollers mounted thereon.

In use, the claimed soft surface cleaning apparatus is attached to a soft surface cleaning device 200. An example of a conventional soft surface cleaning device 200 having a pair (only one roller is visible from this front view) of cylindrical rollers 10 mounted thereon is shown in FIG. 20. There is a rotatable support means 60 and a means for powering the rotatable support means (not shown) so that the pair of rollers 10 can contact and rotatably engage a soft surface, as described below. The means for powering the rotatable support means 60 is a gear driven motor, for example. A bottom view of the device 200 having a pair of cylindrical rollers 10 mounted thereon is shown in FIG. 21.

In another alternate embodiment, the claimed apparatus is an adapter in the form of a sleeve or cover that can be placed on or attached to a conventional soft surface cleaning device; i.e., one that does not have spaced-apart recesses. In one embodiment, the adapter is a cylindrical sleeve having a rigid surface with a plurality of spaced apart recesses therein for contact with a soft surface to be cleaned. In another embodiment, the adapter is a rotatable rigid disk-shaped cover with a plurality of spaced apart recesses therein for contact with a soft surface to be cleaned. The adapters have a configuration that is complementary to an attachment means on the soft surface cleaning device. In an example, the cylindrical sleeve is placed over a conventional core and an inner surface of the sleeve is in frictional engagement with an outer diameter of the conventional core. In another example, the disk-shaped cover is placed over the conventional disk core and may have a securing means such as an elastic band or cinching straps around its perimeter to more effectively secure the cover to the core. Once placed on or secured to the core, the adapter will function in the same way and will provide the same advantages as described herein and above. The method of using the adapters is substantially the same as the methods of use described above.

A method of using the cylindrical soft surface cleaning apparatus is described as part of the invention. In a first step, the cylindrical roller 10 is attached to the soft surface cleaning device 200 by the rotatable support means 60, as shown in FIGS. 20-21. Next, the means for powering the rotatable support means is started. Then, the device 200 with the roller 10, and optionally a pair of rollers 10 attached is moved forwards and backwards across the soft surface to be cleaned so that the roller 10 rotatably contacts and engages the soft surface. The cylindrical roller 10 rotates about the x-axis. As the roller 10 rotates, a plurality of points on the soft surface come into contact with or are engaged by the rigid surface 15 of the roller 10. Each of the points of the soft surface that is in contact with the rigid surface 15 is compressed. As the roller 10 rotates, each of the points of the soft surface eventually comes into contact with a surface of one of the plurality of recesses, in this case recess 30. When a point on the soft surface is in contact with a surface of one of the recesses 30, the point on the soft surface is decompressed. As the roller 10 continues to rotate, the point on the soft surface again eventually comes into contact with the rigid surface 15 of the roller 10, recompressing the point. The alternating compression, decompression, and recompression of the soft surface are achieved by the spaced-apart recesses 30 and provide a gentle and effective mechanical action necessary to massage the soft surface. The design of the claimed invention enhances removal of foreign matter from deep within the irregularities of a soft surface without pulling on the soft surface material. The steps of moving the apparatus and compressing, decompressing, and recompressing the soft surface may be repeated at least one time to maximize removal of debris and foreign matter from the soft surface. The claimed method may further comprise the step of applying cleaners to the soft surface, as described below.

A method of using the rigid disk shaped soft surface cleaning apparatus is also claimed. In a first step, the disk 110 is attached to the soft surface cleaning device (not shown) by the rotatable support means. Next, the means for powering the rotatable support means is started. Then, the device 200 with the disk-shaped apparatus attached is moved horizontally across the soft surface to be cleaned so that the disk 110 rotatably contacts and engages the soft surface. The disk 110 rotates about the y-axis. As the disk rotates, a plurality of points on the soft surface come into contact with or are engaged by the rigid disk 110. Removal of debris and foreign matter is enhanced from deep within the soft surface, as described in detail above. As the disk 110 rotates, there is an alternating compression, decompression, and recompression of the points on the soft surface as the points alternately come into contact with a plurality of points on the rigid disk 110 and a surface of one of the plurality of recesses in the rigid disk 110. As described above, the steps of moving the apparatus and compressing, decompressing, and recompressing the soft surface may be repeated at least one time to maximize removal of debris and foreign matter from the soft surface. The claimed method may further comprise the step of applying cleaners to the soft surface, as described below.

Figure 23:
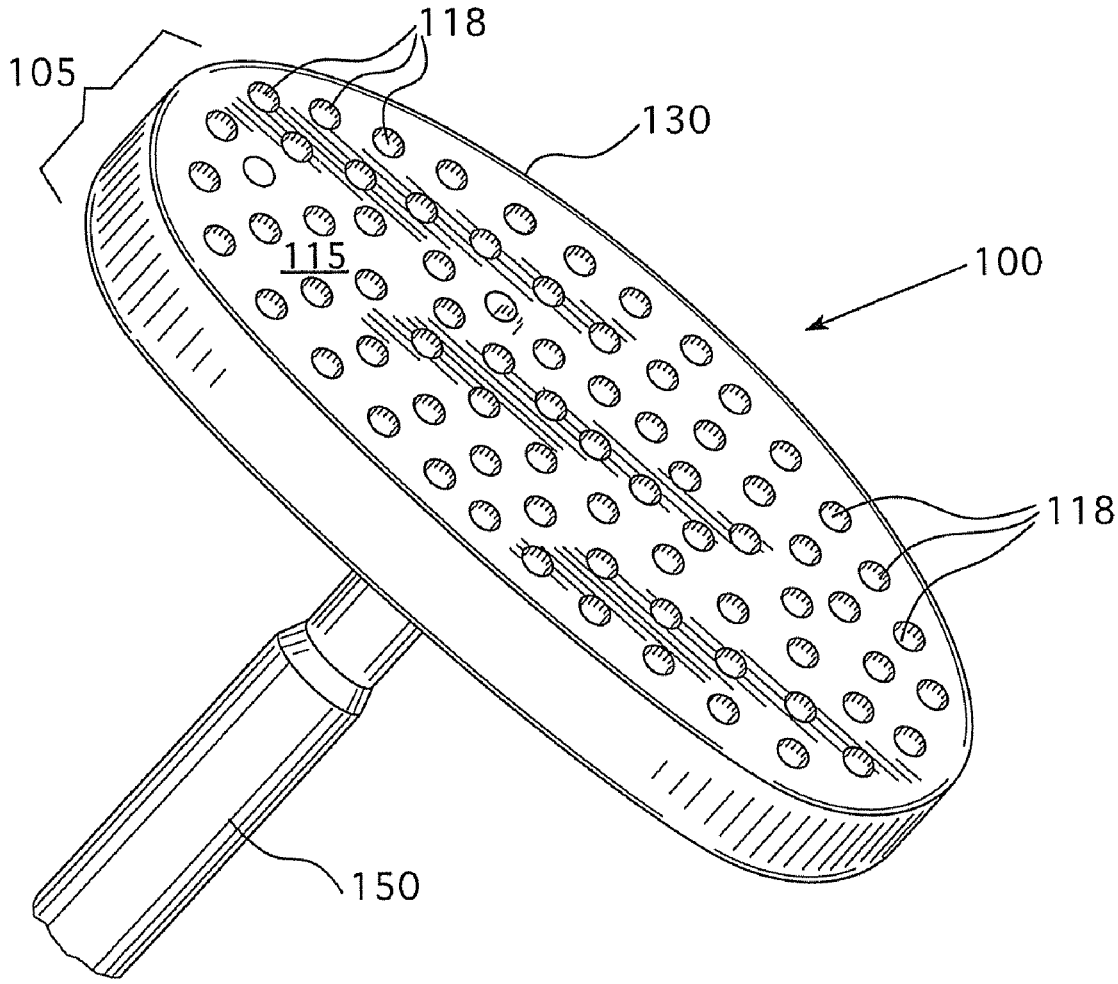
FIG. 23 is a bottom perspective view of a first embodiment of the hand-operated cleaning device including an optional handle.
Figure 24:
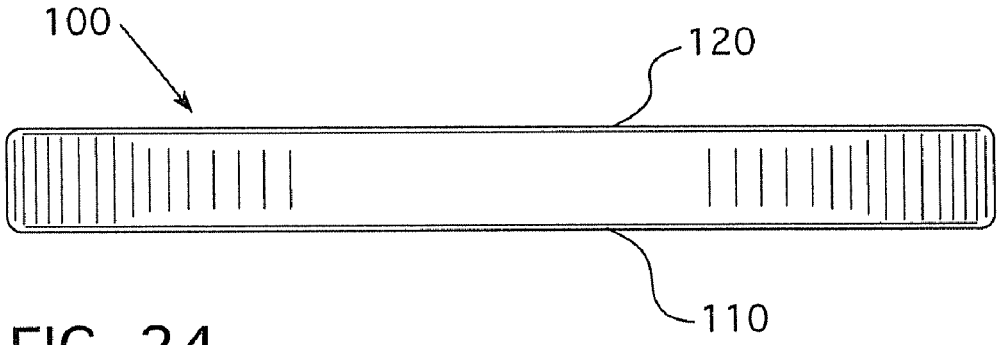
FIG. 24 is a side elevational view of the hand-operated cleaning device shown in FIG. 23 without the handle.
Figure 30:
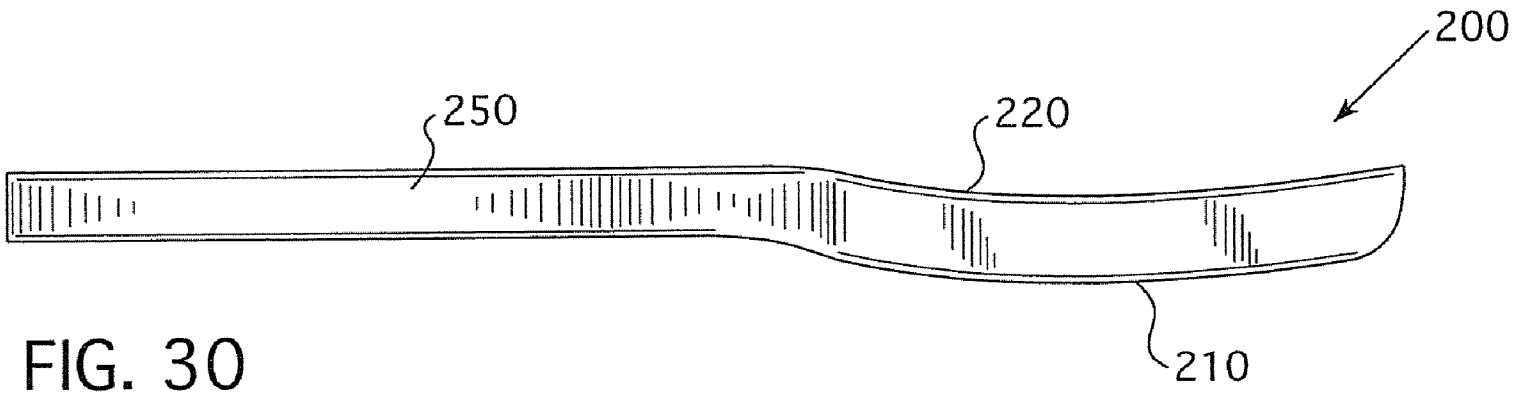
FIG. 30 is a side elevational view of the hand-operated cleaning device shown in FIG. 29.
Figure 31:
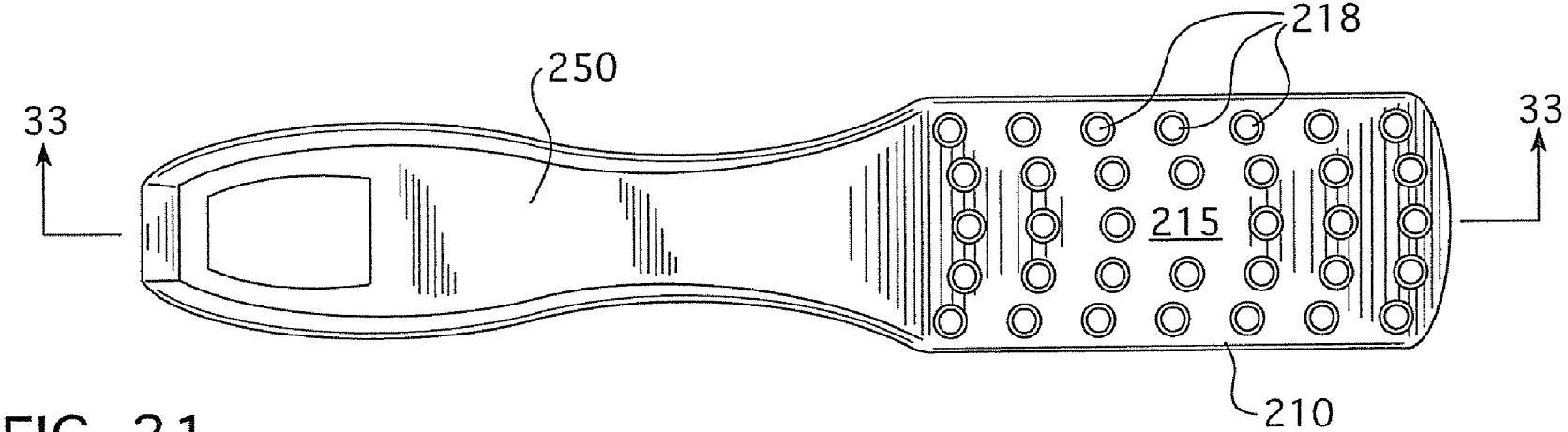
FIG. 31 is a top view of the hand-operated cleaning device shown in FIG. 28.
Figure 32:
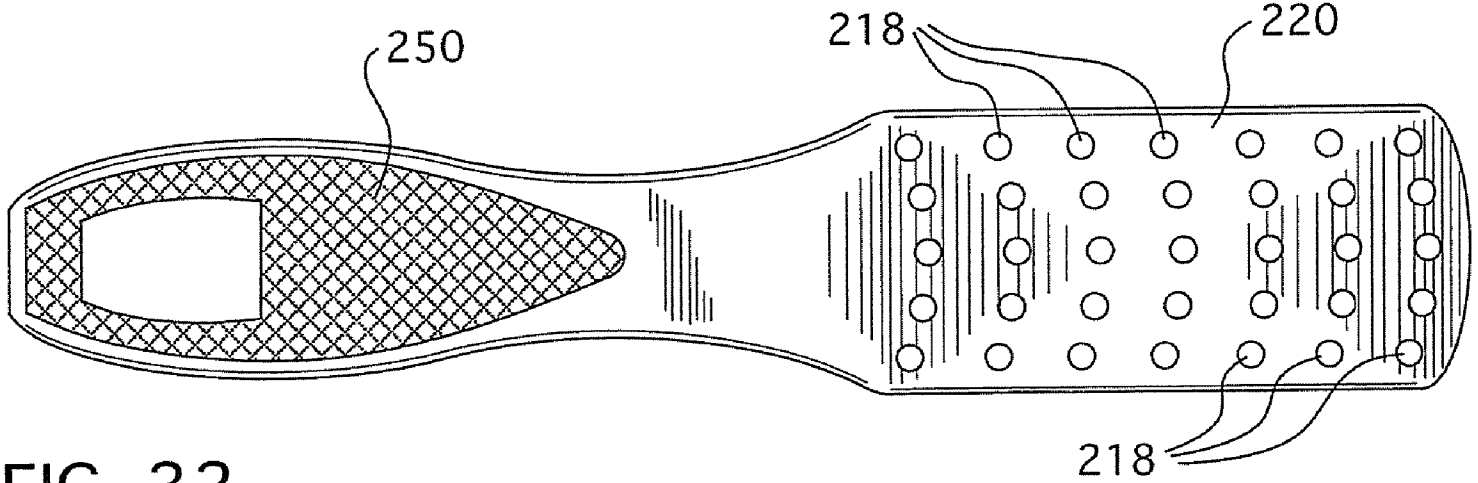
FIG. 32 is a bottom view of the hand-operated cleaning device shown in FIG. 28.
Figure 33:
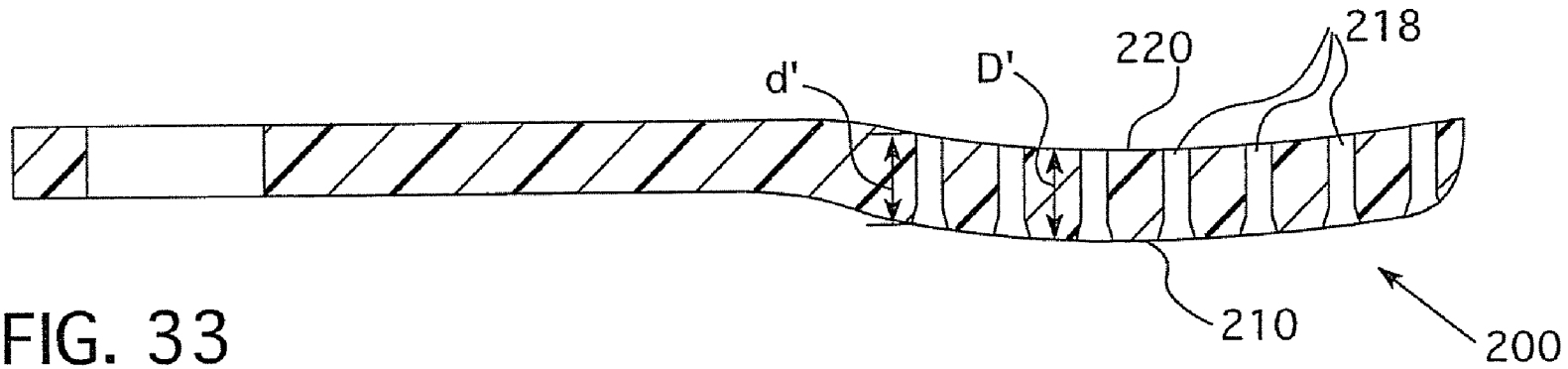
FIG. 33 a cross-sectional view of the hand-operated cleaning device shown in FIG. 31 along line 33-33.

Embodiments of a hand-operated cleaning device 100, 200, 300 for use with a soft surface are shown in FIGS. 23-34. In the embodiments shown in FIGS. 23-33, the hand-operated cleaning device 100, 200 comprises a body 105, 205 that has first 110, 210 and second 120, 220 sides. The body 105, 205 has a depth D, D'. The first side 110, 210 has a rigid surface 115, 215 without projections. In an example, first side is substantially flat as shown in FIG. 24. In another example, first side has a convex curvature as shown in FIG. 30.

Figure 34:
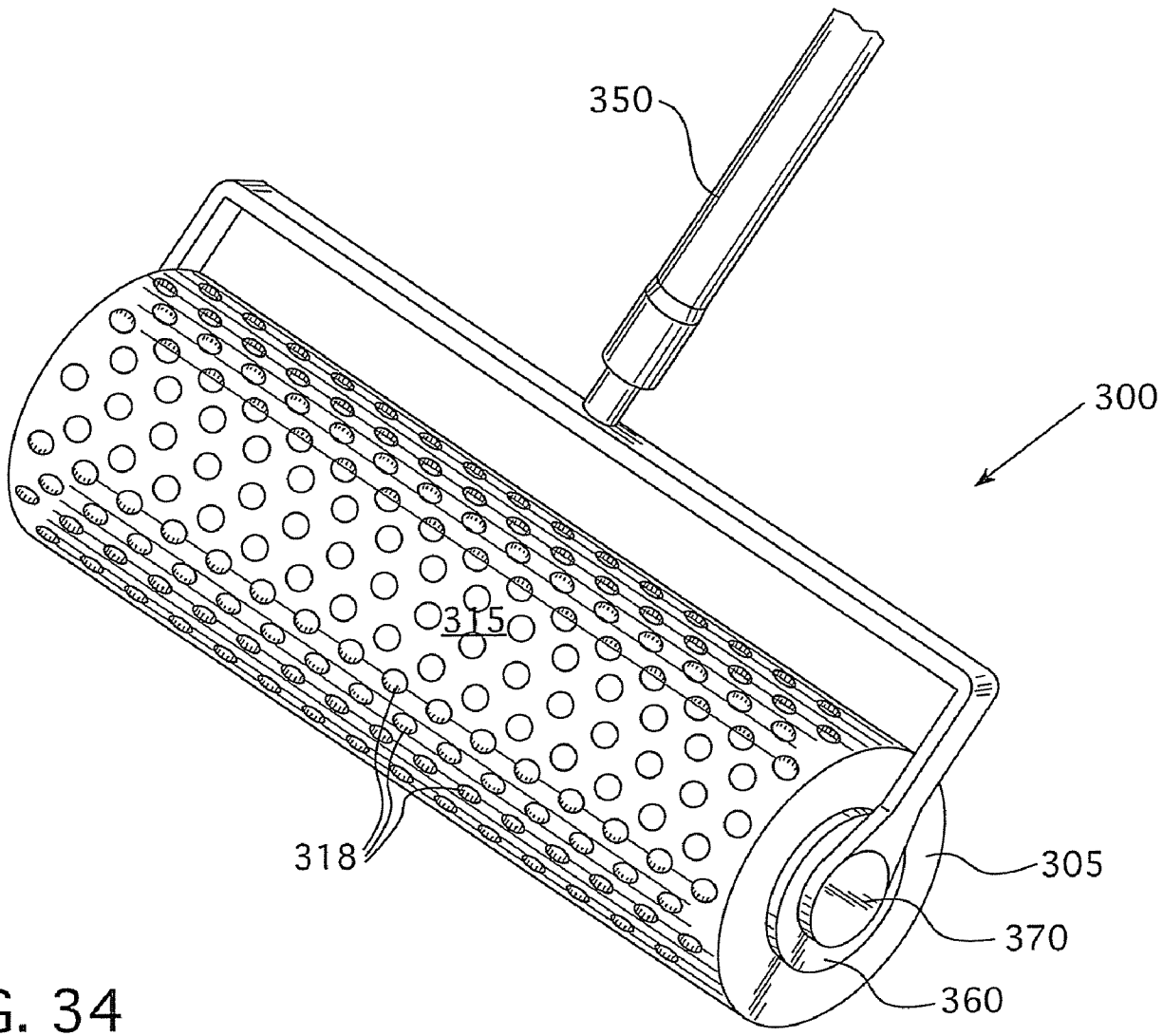
FIG. 34 is a perspective view of a third embodiment of the hand-operated cleaning device.

In the embodiment shown in FIG. 34, the hand-operated cleaning device 300 comprises a rotatable body 305 having a rigid surface 315 without projections. Optionally, the rotatable body 305 is cylindrical. The hand-operated device 300 includes a handle 350 attached to rotatable support means 360 for rotatably supporting the device 300. Rotatable support means 360 includes axle attachment means that holds the axle in place. An axle rod extends through the center of the rotatable body 305 and rotation of the axle causes body 305 to rotate. In an example, rotatable support means is a pair of end caps 370, one inserted into each end of the device 300. Each end cap has axle attachment means inserted therein.

The rigid surface 115, 215, 315 is non-absorbent. In embodiments, the rigid surface 115, 215, 315 is made from polyethylene, polypropylene, stainless steel, ceramic, wood, aluminum, or any other non-absorbent material known to those skilled in the art.

The rigid surface 115, 215, 315 has a plurality of spaced-apart recesses 118, 218, 318 therein. See FIGS. 23, 26, 27, 29, 32-34. Optionally, an edge of each of the spaced-apart recesses is beveled. See FIGS. 29, 31-33. The recesses may be any shape, including but not limited to conical, round, oblong, elliptical, forked, rectangular, square, x-shaped, or triangular. In the embodiment shown in FIG. 27, each recess 118 has a depth d that is less than a depth D of the body. In the embodiment shown in FIG. 33, each recess 218 has a depth d' that is substantially equal to the depth D' of the body such that the recesses 218 extend from the first side 210 of the body 205 to the second side 220 of the body 205. In embodiments such as the one shown in FIG. 33, any excess cleaning compound may travel through the recesses to the second side 220 of the body 205 and be removed from the soft surface.

Figure 25:
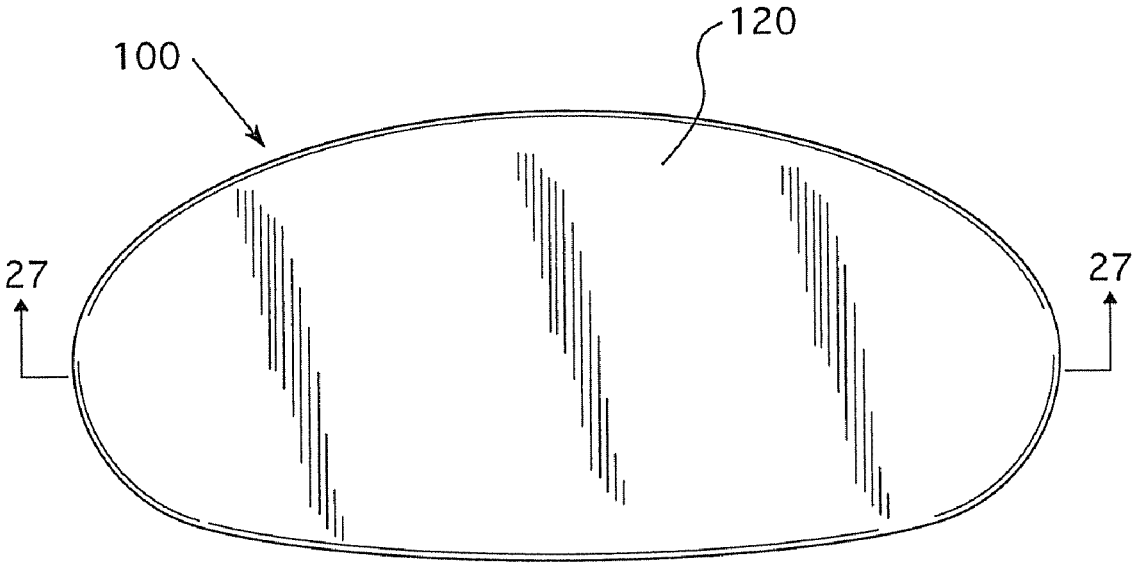
FIG. 25 is a top view of the hand-operated cleaning device shown in FIG. 24.
Figure 26:
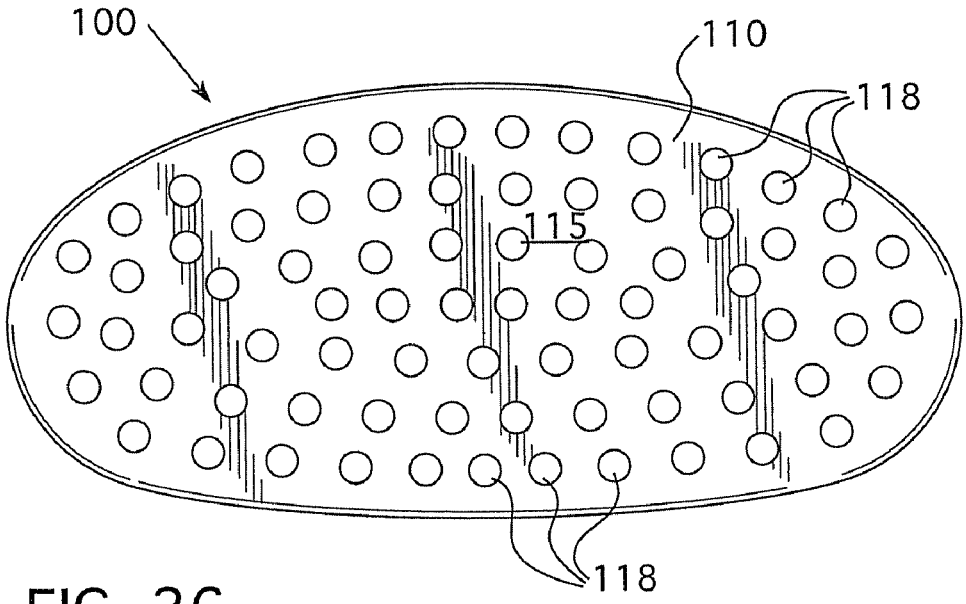
FIG. 26 is a bottom view of the hand-operated cleaning device shown in FIG. 24.
Figure 27:
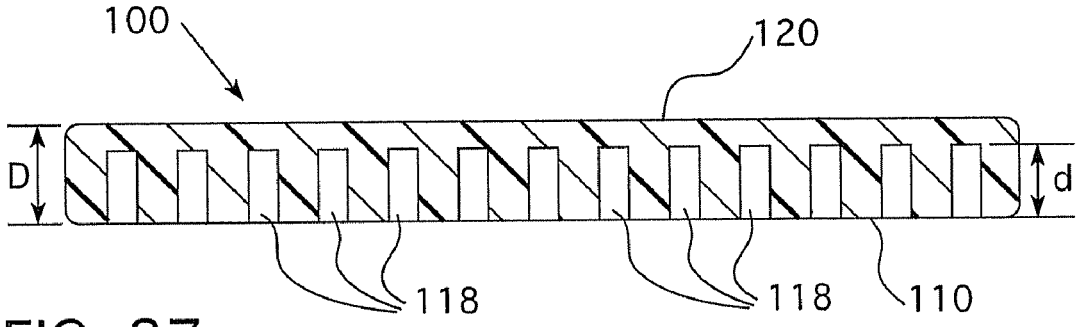
FIG. 27 is a cross-sectional view of the hand-operated cleaning device shown in FIG. 25 along line 27-27.
Figure 28:
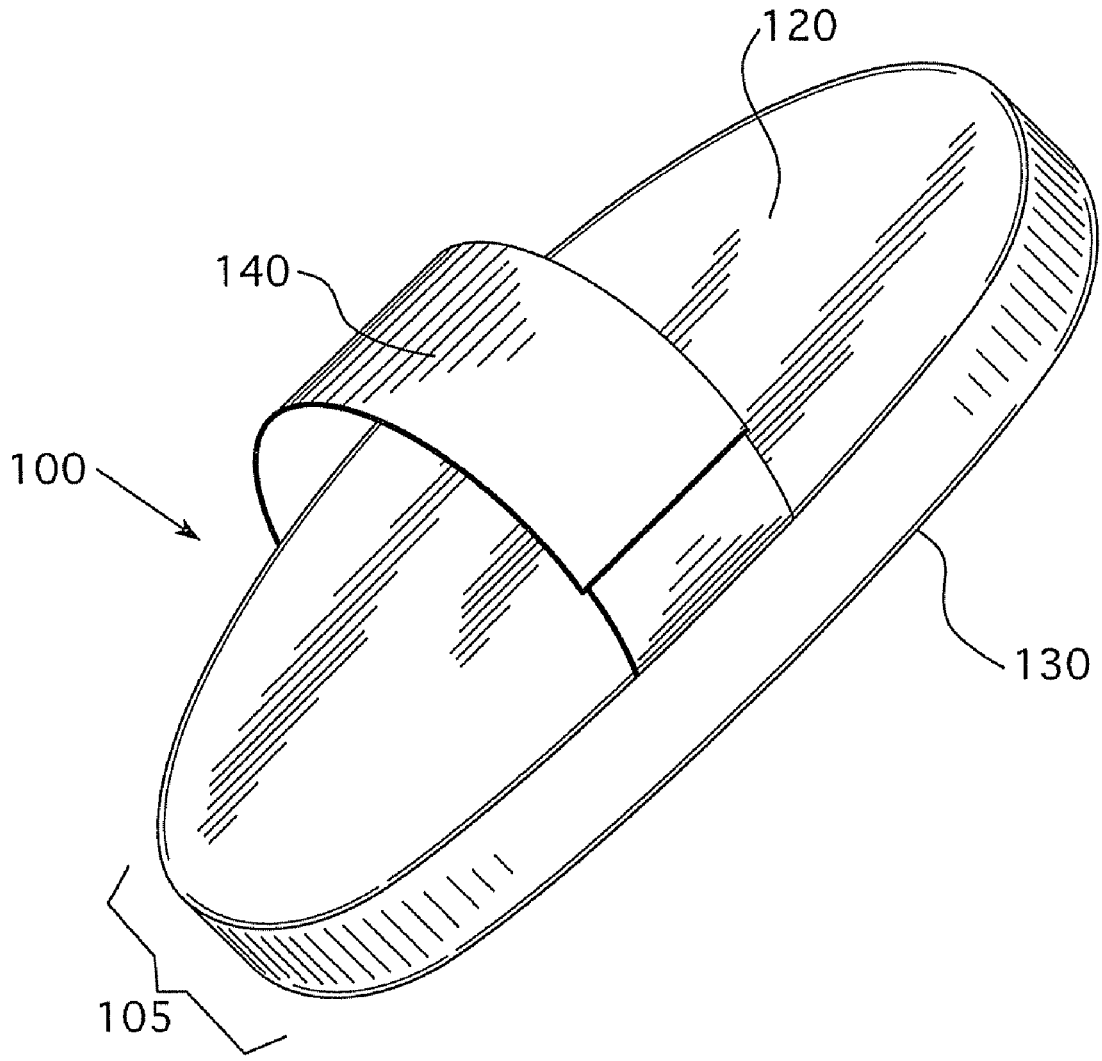
FIG. 28 is a perspective view of the hand-operated cleaning device shown in FIG. 24 and including an optional strap.
Figure 29:
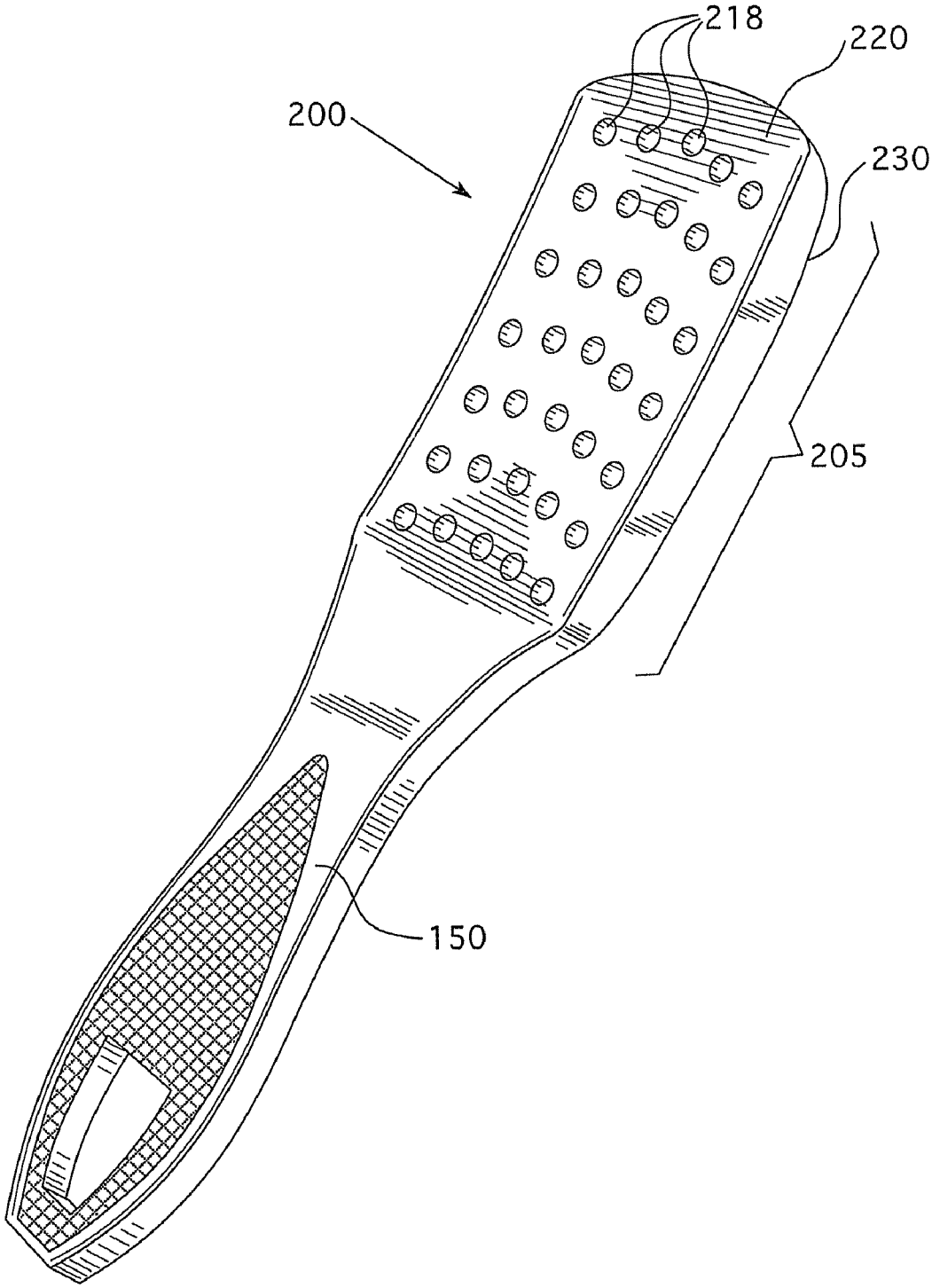
FIG. 29 is a bottom perspective view of a second embodiment of the hand-operated cleaning device.

In the embodiment shown in FIG. 25, the second side 120, 220 of the body 105, 205 is configured to be gripped by a user. In embodiments, second side 120, 220 is either substantially flat or has an ergonomic shape to fit a user's hand. As shown in FIGS. 23 and 28, respectively, the device 100 optionally includes a handle 150 or a strap 140 attached to the body 105. Handle 150 may be removable. Strap 140 may be adjustable to accommodate a variety of user sizes. In the embodiment shown in FIGS. 29-33, the hand-operated device 200 includes a handle 250 attached to the body 205. Optionally, the handle is removable. Optionally, handle 250 is integral with the body 205, as shown in FIGS. 29-33. In the embodiment shown in FIG. 34, a handle 350 is attached to rotatable support means 360. Optionally, handle 360 is removable.

The body 105, 205 also has a scraping edge 130, 230 that is adjacent to one of the sides 110, 210, 120, 220. The scraping edge 130, 230 is used to remove matter from a periphery of the soft surface following application of a cleaning compound to the soft surface. Optionally, the scraping edge 130, 230 is beveled.

In an embodiment, a kit that includes a hand-operated cleaning device 100, 200 such as the ones shown in FIGS. 23-31 and a cleaning compound is disclosed. The cleaning compound is either a liquid, a solid, or a foam.

In use, a cleaning compound is applied to the soft surface to be cleaned. The rigid surface 115, 215, 315 of the body 105, 205, 305 of the hand-operated cleaning device 100, 200, 300 is placed on the soft surface and is moved across the soft surface, preferably in a substantially circular motion starting from the outside and working toward the center of the spot, such that the rigid surface 115, 215, 315 contacts and engages the periphery of the fibers comprising the soft surface. As the rigid surface 115, 215, 315 is moved across the soft surface, the rigid surface 115, 215, 315 engages a plurality of points on the soft surface. Each of the points of the soft surface that is in contact with the rigid surface 115, 215, 315 is compressed. As the hand-operated device 100, 200, 300 is moved, each of the points of the soft surface eventually comes into contact with one of the recesses 118, 218, 318 and is decompressed. As the hand-operated device 100, 200, 300 continues to be moved across the surface, the point on the soft surface again comes into contact with the rigid surface 115, 215, 315 and that point is recompressed. The alternating compression, decompression, and recompression of the soft surface are achieved by the rigid surface 115, 215, 315 and spaced-apart recesses 118, 218, 318 and provide a gentle and effective mechanical action that massages the soft surface to remove foreign matter from deep within the soft surface without damaging the soft surface by pulling on it or using brushes or bristles to pull foreign matter to the surface. In use, the scraping edge 130, 230 may be scraped along the soft surface following the alternating compression, decompression, and recompression in order to scrape off of the upper portion of the soft surface any excess cleaning compound or foreign matter that has been removed from deep within the soft surface.

The claimed design allows for the use of both wet and dry cleaning chemicals or compounds to be used to assist in foreign matter removal. The skilled artisan will appreciate the variety of cleaning compounds used for soft surface cleaning. There is no restriction on what cleaning compound could be used with the present invention. It has been found that the recesses or indentures in the rigid surface of the roller, the rigid disk, or the hand-operated cleaning device facilitate the insertion of a cleaning chemical or compound into the irregularities of the soft surface to assist in causing the release of foreign matter that is adhered to and within the soft surface. The compression and decompression of the soft surface caused by the claimed agitator, along with a cleaning compound, assists in the removal of foreign matter. As described above, this is because the recesses facilitate the mechanical removal of foreign matter as the soft surface cleaning apparatus moves across the soft surface.

While the foregoing has been set forth in considerable detail, it is to be understood that the drawings and detailed embodiments are presented for elucidation and not limitation. Design variations, especially in matters of shape, size and arrangements of parts maybe made but are within the principles of the invention. Those skilled in the art will realize that such changes or modifications of the invention or combinations of elements, variations, equivalents or improvements therein are still within the scope of the invention as defined in the appended claims.

I claim:

1. A cleaning kit for cleaning a soft surface having a plurality of fibers, comprising:

a. a hand-operated cleaning device comprising a body that includes a first side having a rigid surface without projections for engaging said soft surface and a plurality of spaced apart recesses therein; and b. a cleaning compound for application to said soft surface, wherein said cleaning compound is massaged into said soft surface as said rigid surface compresses said fibers of said soft surface and said recesses decompress said fibers, wherein said compression and decompression of said fibers causes matter to be drawn from below a top of said soft surface to said top.

2. The kit as in claim 1, wherein said body is cylindrical.

3. The kit as in claim 1, wherein said body is rotatable.

4. The kit as in claim 1, wherein an edge of each of said recesses is beveled.

5. The kit as in claim 1, wherein at least one of said recesses has a depth that is less than a depth of said body.

6. The kit as in claim 1, wherein at least one of said recesses has a depth that is substantially equal to a depth of said body.

7. The kit as in claim 1, wherein a shape of said recesses is selected from the group consisting of conical, round, oblong, elliptical, forked, rectangular, square, x-shaped, and triangular.

8. The kit as in claim 1, wherein said body includes a scraping edge for removing matter from a top of said soft surface following application of said cleaning compound.

9. The kit as in claim 1, wherein said cleaning compound is selected from the group consisting of a liquid, a solid, and a foam.

* * * * *